US006361285B1

(12) United States Patent
Lehner

(10) Patent No.: US 6,361,285 B1
(45) Date of Patent: Mar. 26, 2002

(54) VALVE PLATE WITH HYDRAULIC PASSAGEWAYS FOR AXIAL PISTON PUMPS

(75) Inventor: Thomas Lehner, Schleiden (DE)

(73) Assignee: Parker Hannifin GmbH, Kaarst (DE)

( * ) Notice: Subject to any disclaimer, the term of this patent is extended or adjusted under 35 U.S.C. 154(b) by 0 days.

(21) Appl. No.: 09/468,806

(22) Filed: Dec. 21, 1999

(30) Foreign Application Priority Data

Dec. 22, 1998 (DE) ..... 198 59 328

(51) Int. Cl.[7] ..... F04B 1/12; F04B 23/00; F04B 11/00; F01B 1/00

(52) U.S. Cl. ..... 417/269; 417/441; 417/540; 417/542; 91/6.5

(58) Field of Search ..... 417/269, 272, 417/540, 542, 270, 521, 522, 222.1, 222.2, 441; 137/565.17, 565.34; 91/6.5

(56) References Cited

U.S. PATENT DOCUMENTS

| | | | | |
|---|---|---|---|---|
| 3,199,461 A | * | 8/1965 | Wolf | 103/162 |
| 3,250,227 A | | 5/1966 | Kouns | 103/162 |
| 3,585,901 A | * | 6/1971 | Moon, Jr. | 91/6.5 |
| 3,667,867 A | | 6/1972 | Boydell et al. | 417/222 |
| 3,727,521 A | | 4/1973 | Reynolds | 91/475 |
| 3,752,053 A | | 8/1973 | Wouters et al. | 91/485 |
| 3,774,505 A | | 11/1973 | McLeod | 91/506 |
| 3,800,672 A | | 4/1974 | Kobald | 91/487 |
| 3,858,483 A | * | 1/1975 | Hein | 91/6.5 |
| 3,956,969 A | * | 5/1976 | Hein | 91/6.5 |
| 4,007,663 A | * | 2/1977 | Nagatomo et al. | 91/6.5 |
| 4,019,425 A | | 4/1977 | Matzelle | 91/487 |
| 4,037,521 A | | 7/1977 | McLeod | 91/499 |
| 4,048,903 A | | 9/1977 | Roberts | 91/6.5 |
| 4,096,786 A | * | 6/1978 | Schauer | 91/499 |
| 4,212,596 A | | 7/1980 | Ruseff | 417/216 |
| 4,366,672 A | | 1/1983 | Claar et al. | 60/452 |
| 4,540,345 A | | 9/1985 | Frazer | 417/269 |
| 4,934,251 A | | 6/1990 | Barker | 91/486 |
| 5,076,145 A | | 12/1991 | Born et al. | 92/12.2 |
| 5,105,723 A | | 4/1992 | Kazahaya et al. | 91/485 |
| 5,123,815 A | | 6/1992 | Larkin et al. | 417/222 R |
| 5,253,983 A | | 10/1993 | Suzuki et al. | 417/485 |
| 5,538,401 A | * | 7/1996 | Schaffner et al. | 417/222.1 |
| 5,572,919 A | | 11/1996 | Ishizaki | 91/499 |
| 5,593,285 A | | 1/1997 | Watts | 417/269 |
| 5,785,150 A | | 7/1998 | Tominaga et al. | 184/6.17 |
| 5,803,714 A | | 9/1998 | Tominaga et al. | 417/269 |
| 5,809,863 A | | 9/1998 | Tominaga et al. | 92/57 |
| 5,931,644 A | | 8/1999 | Glassey et al. | 417/269 |

FOREIGN PATENT DOCUMENTS

| | | | |
|---|---|---|---|
| DE | 27 22 718 | 12/1976 | |
| DE | 26 01 970 | 7/1977 | |
| DE | 26 13 478 | 10/1977 | F04B/1/20 |
| DE | 197 06 114 A1 | 8/1998 | F04B/11/00 |
| JP | 07189887 | 7/1995 | F04B/1/20 |
| WO | WO 9530833 | 11/1995 | F04B/1/20 |

* cited by examiner

*Primary Examiner*—Timothy S. Thorpe
*Assistant Examiner*—Timothy P. Solak
(74) *Attorney, Agent, or Firm*—John A. Molnar, Jr.

(57) ABSTRACT

An axial piston pump of the swash-plate variety having a rotating cylinder block and pistons movable in a longitudinal direction within bores formed in the block, and having a reversing capacitance for reducing pressure pulsations. For the further reduction of such pulsations, one or more channels, each having an associated discharge opening, are formed into a web of the valve plate of the pump to sequentially couple the reversing capacitance into fluid communication with the cylinder bores passing across the web.

11 Claims, 3 Drawing Sheets

VALVE PLATE WITH HYDRAULIC PASSAGEWAYS FOR AXIAL PISTON PUMPS

CROSS-REFERENCE TO RELATED APPLICATION

This application claims priority to German Application No. DE 198 59 328.7, filed Dec. 22, 1998, the disclosure of which is incorporated herein by reference.

BACKGROUND OF THE INVENTION

The present invention relates to an axial piston pump of a swash plate variety having a driven rotating cylinder block or drum and a large number of cylinder bores arranged radially therein, each of the bores being separated within the cylinder drum by a web of cylinder drum material. Pistons are arranged in each of the cylinder bores to be reciprocatingly movable in an axial, linear direction relative to the rotation of the cylinder drum between, at the end of a de-compression stroke, a bottom dead center position and, at the end of a compression stroke, a top dead center position. A valve plate having a low pressure connection port and a high pressure connection port also is provided, with the low and high pressure connection ports being separated in the valve plate by a web of valve plate material. The rotation of the cylinder drum causes the cylinder bores to be aligned in alternating fashion with the low-pressure connection port and the high-pressure connection port. Concurrently, the cylinder bores sweep past the web in the valve plate separating the low and high pressure connection ports, whereupon a reversing capacitance in fluid communication with the sweeping cylinder bore via at least one channel is supplied through the valve plate to mitigate the effects of a pressure pulsation.

The structure and operation of axial piston pumps of the type herein involved is described in further detail in the publication "Measures For The Reduction Of High-Pressure-Side Pulsations Of Hydrostatic Swash Plate Units" by Marcus Jarchow, Dissertation 1997, Aachen Institute of Technology, Verlag Mainz, Aachen, and in the following U.S. Pat. Nos.: 3,250,227; 3,667,867; 3,774,505; 4,037,521; 4,212,596; 4,366,627; and 5,123,815. The Jarchow publication deals in particular with the problem of high-pressure-side pulsations, and sets forth a solution which involves a reversing capacitance. In this regard, in order to avoid compression oil flows when each individual cylinder bore of the cylinder block is aligned with the high-pressure connection port, it is necessary to adjust the pressure forming in the cylinder bore through the compression movement of the piston to the pressure prevailing on the high-pressure side of the control base in its high-pressure connection port. Through the use of a reversing capacitance, this adjustment is effected by admitting compression oil under high pressure into the cylinder bore. This reversing capacitance is formed in the control base via a channel in communication with the cylinder bores of the rotating cylinder block and, respectively, via an additional channel with the high-pressure connection port.

It has been observed, however, that the undesirable high-pressure-side pulsations continue to occur in attenuated form even with the use of a reversing capacitance. In this regard, the clearing of the channel extending from the reversing capacitance through the web between each of the cylinder bores results in an abrupt pressurization of the cylinder bore as the compression oil is admitted under high pressure from the reversing capacitance. An object of the present invention therefore is to further reduce the development of pulsations in an axial piston pump, and to ensure a less abrupt alignment of the cylinder bore with the high-pressure connection port.

BROAD STATEMENT OF THE INVENTION

Broadly, the present invention is directed to the provision of one or more channels, each having an associated discharge opening, which are formed in the web of the valve plate to couple the reversing capacitance in fluid communication sequentially with each of the cylinder bores passing across the web.

According to one exemplary embodiment of the invention, at least two such channels are provided which are arranged on an arc defined by the low and high pressure connection ports. Optionally, the discharge openings and their associated channels may have the same or different diameters.

According to another exemplary embodiment of the invention, particularly if two channels are provided, the discharge openings of the channels are connected with each other via a recess formed in the web of the valve plate, such recess surrounding the discharge openings.

For a further improvement of a positioning of the cylinder bores the discharge openings of the channels extending from the reversing capacitance to each of the cylinder bores via the web formed on the valve plate are equipped with adjoining guide-in notches and/or guide-out notches. In one exemplary embodiment, the first discharge opening relative to the direction of rotation of the cylinder block is provided with a longer guide-in notch and a shorter guide-out notch adjoining the discharge opening. In addition, in the case of two channels being formed through the valve plate web, the second discharge opening relative to the direction of rotation of the cylinder block is provided with a shorter guide-in notch and a longer guide-out notch. Similarly, if a recess is formed surrounding the discharge openings of the two channels, this recess may be provided with a guide-in notch and/or a guide-out notch.

The present invention, accordingly, comprises the apparatus and method possessing the construction, combination of elements, and arrangement of parts and steps which are exemplified in the detailed disclosure to follow. Advantages of the invention includes an axial piston pump construction which reduces undesirable high-pressure-side pulsations. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
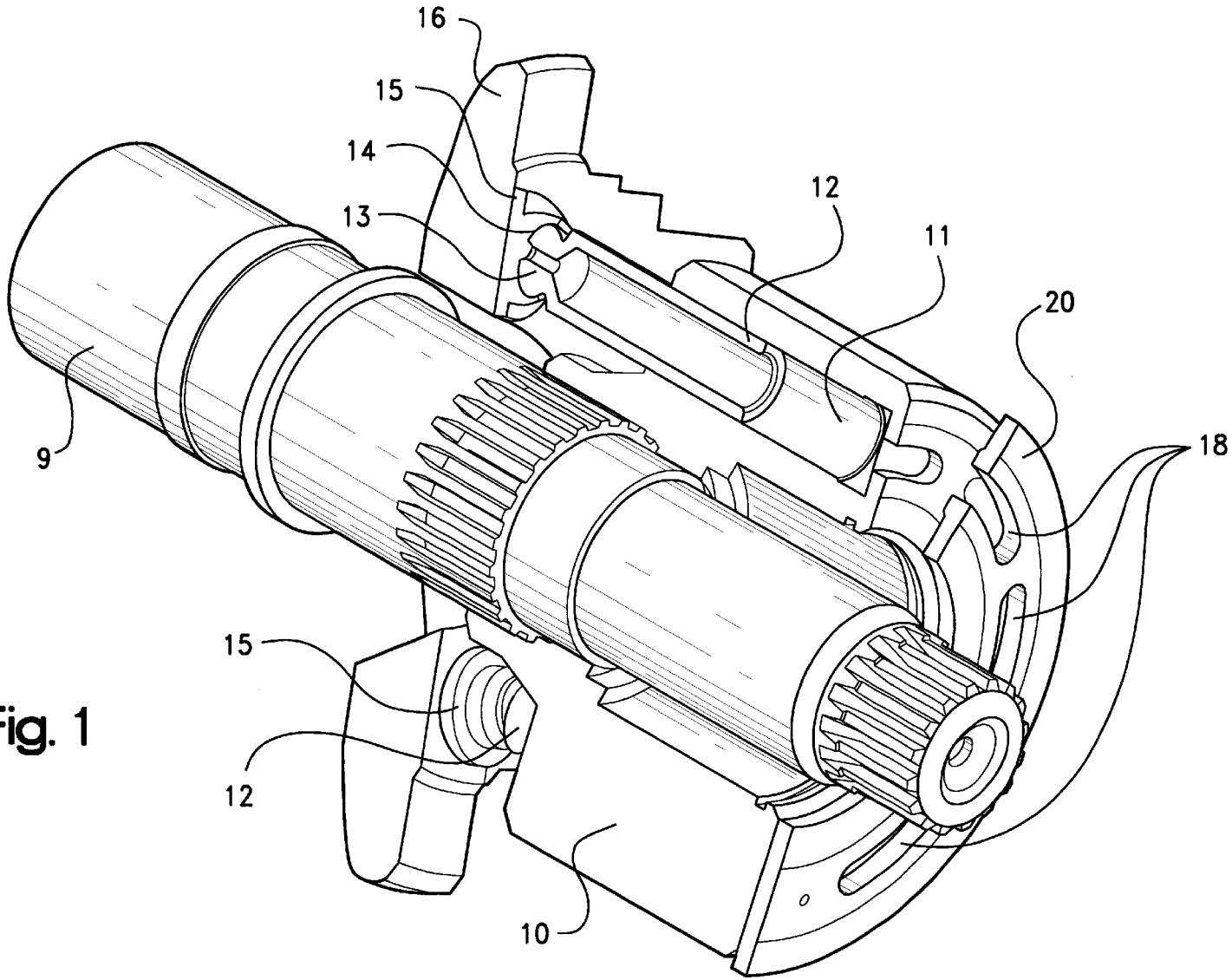
FIG. 1 shows a swash plate-type axial piston pump in a generally schematic representation.

An important element of the axial piston pump construction shown in FIG. 1 is a cylinder block or drum 10 which will be readily understood to be rotatable by a drive (not shown) coupled to the drum via a shaft 9. Cylinder bores 11 are spaced-apart radially in the outer area of the cylinder block, with a piston 12 being received with each of the bores 11 to be reciprocatingly movable in a linear, axial direction. A ball, 13, of each of the pistons 12 is supported on one face of cylinder block 10 within the socket 14 of a guide shoe 15 disposed outside of cylinder block 10. Guide shoe 15 bears upon a rotationally stationary swash plate 16 such that the rotation of cylinder block 10 in relation to the swash plate 16 can be converted into a linear motion of the pistons 12 in cylinder bores 11, which motion is directed axially relative to the axis of rotation of block 10.

A valve plate 20 is arranged fixedly on the face of cylinder block 10 opposite swash plate 16. High pressure connection ports, commonly referenced at 18, are formed to extend along an arc over a portion of the circumference of the valve plate 20, with corresponding low pressure connection ports, referenced at 19 in the views of FIGS. 2–5, also being formed in the control plate for the low-pressure range. As may be seen with additional reference to FIGS. 2–5, connection ports 18 and 19 are separated a web 26, of material in valve plate 20 (FIG. 2).

Figure 2:
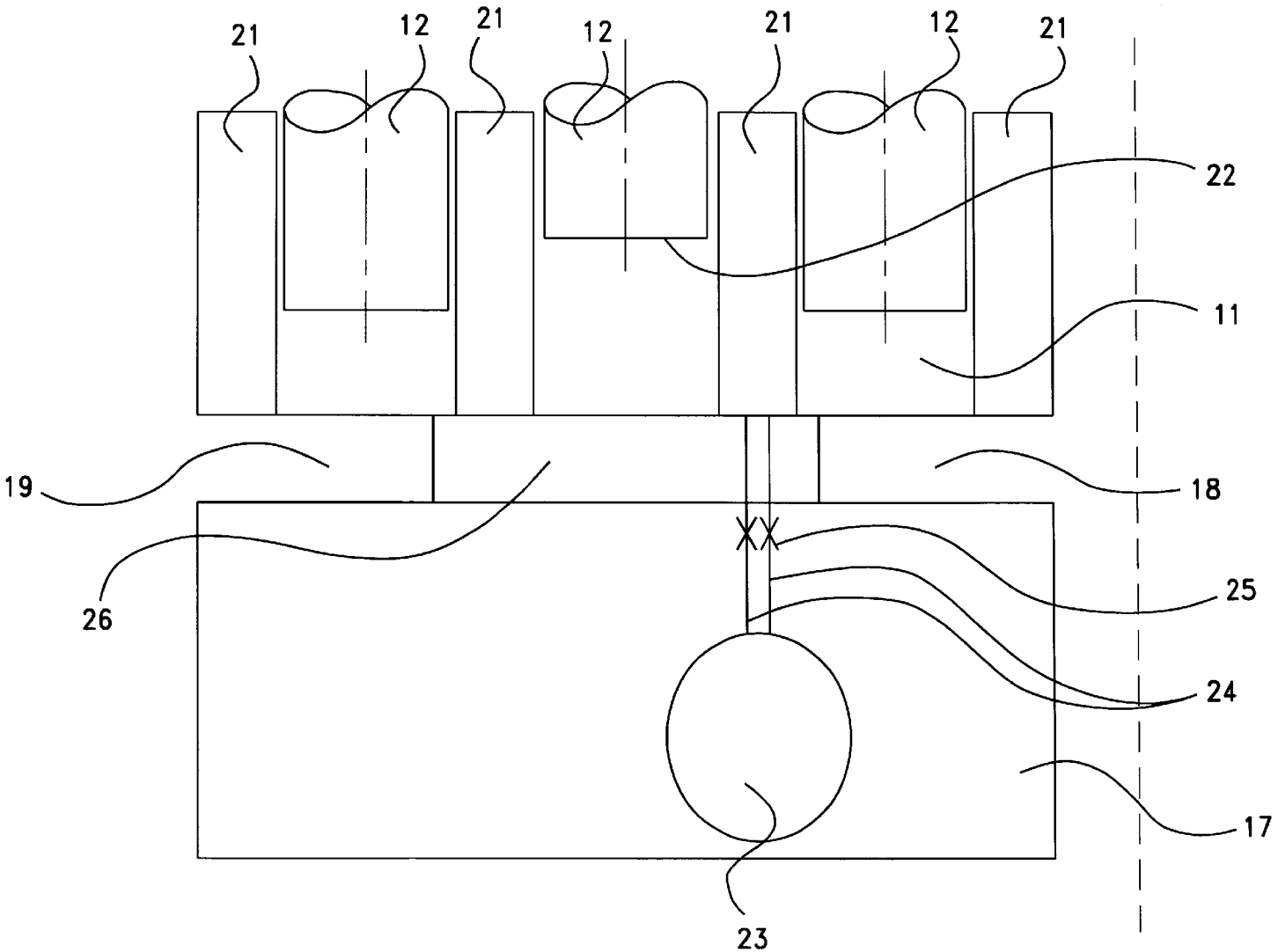
FIG. 2 shows the reversal of one of the pistons of the pump of FIG. 1 while occluded by a supplied reversing capacitance.

A transition of the connection of cylinder bore 11 with low-pressure connection port 19 and high pressure connection port 18 is shown schematically in FIG. 2, such reversal being effected by means of a reversing capacitance. For this purpose, a reversing capacitance 23 is formed in connection plate 17 from which the two channels commonly referenced at 24 extend to the face of cylinder block 11 and empty into a corresponding discharge opening, commonly referenced at 27 in each of the views of FIGS. 3–5. A resistance, 25, each is provided in each of the channels 24.

Looking next to FIG. 2, the control sequence of the pump of FIG. 1 is illustrated with reference to three cylinder bores 11 and their associated pistons 12 which are adjacently-arranged in cylinder block 10. Each of the cylinder bores 11 is separated from an adjacent bore by a web, commonly referenced at 21, of the cylinder block material. In the left-most illustration, the cylinder bore 11 communicates with low-pressure connection port 19, with piston 12 still moving in the direction of its bottom dead center position such that oil is suctioned from the low-pressure connection port 19. Continuing with the center illustration of FIG. 2, piston 12 is now moved to its bottom dead center position 22 wherein the discharge opening 27 of channel 24 is occluded by web 21. As the rotation of cylinder block 10 continues, the discharge opening 27 of channels 24 is unblocked, and the pressure in the cylinder bore 11 is increased with the incipient piston stroke via the supply of compression oil from reversing capacitance 23. Concluding with the right-most, the cylinder bore 11 is now in communication with the high-pressure connection port 18 as the compression stroke of piston 12 proceeds in the direction of its top dead center position. However, the pressure in bore 11 previously has been increased to such an extent that during the connection of the bore 11 to the high-pressure connection port 18, the pressure surge and consequently the pulsation in rotating cylinder block 10 is correspondingly reduced.

Figure 3:
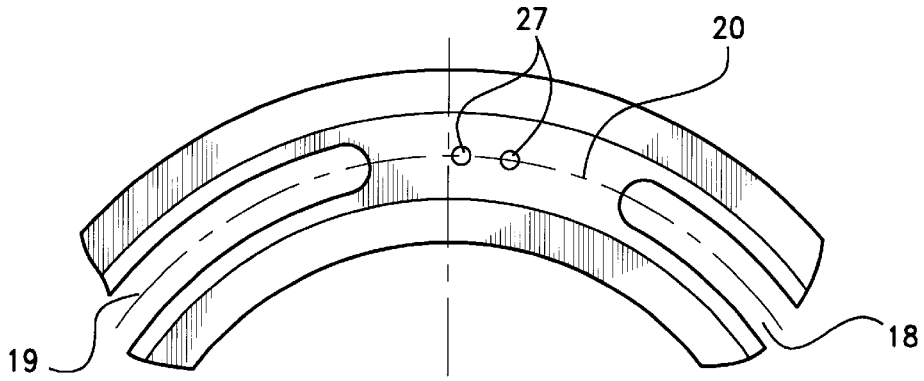
FIG. 3 is a top view of the fixed valve plate of the pump of FIG. 1 showing an arrangement of the discharge openings of the channels provided to couple the cylinder bores into fluid communication with the reversing capacitance.
Figure 4:
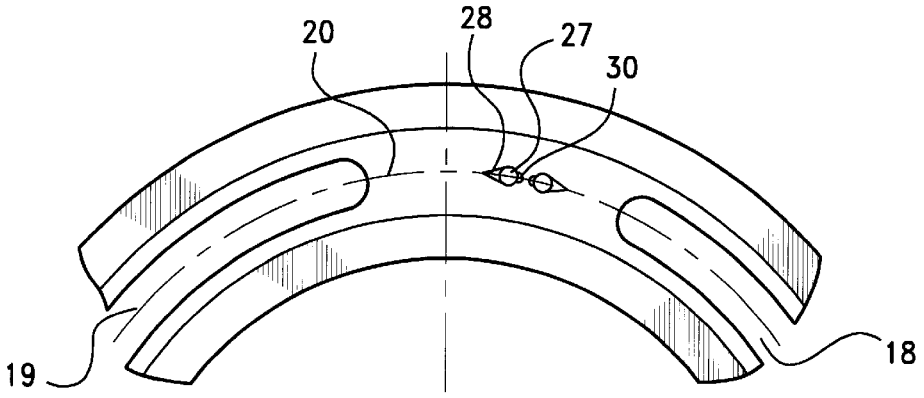
FIG. 4 shows an alternative embodiment of the discharge opening arrangement of FIG.3.
Figure 5:
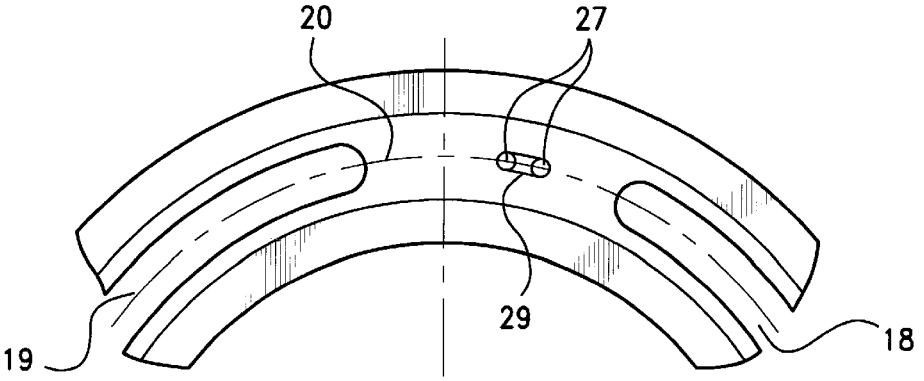
FIG. 5 shows another alternative embodiment of the discharge opening arrangements of FIGS. 3 and 4.

An arrangement according to the present invention of two or more channels 24 is next revealed in the several views of FIGS. 3–5. As may be seen in FIG. 3, two discharge openings 27 of two corresponding channels 24 (FIG. 2) can be arranged in web 26 of valve plate 20. Web 26 separates low-pressure connection port 19 and high-pressure connection port 18, with channels 24 being arranged on the partial arc defined by connection ports 18 and 19.

With reference now to FIG. 4, discharge openings 27 may be seen to be provided with correspondingly-arranged guide-in notches 28 and guide-out notches 30, respectively, the first discharge opening 27 being provided with a guide-in notch 28 having a longer extension and a shorter guide-out notch 30 in the direction of rotation of cylinder block 10 from low-pressure connection port 19 to high-pressure connection port 18. In turn, the second discharge opening 27 located forwardly in the direction of rotation first has a shorter guide-in notch 28 and a longer guide-out notch 30 directed towards high-pressure connection port 18. These guide-in and guide-out notches 28 and 30 are each variable in number, shape, position and size and can thus be designed appropriately to optimize the reversing process.

Another exemplary embodiment of the invention is shown in FIG. 5 wherein the discharge openings 27 of two channels 24 are in communication with each other via a surrounding recess 27 to effect a still further graduation of the activation characteristics. Preferably, recess 29 may be designed to be kidney or oblong-shaped and to be arranged on the arc defined by connection ports 18 and 19. Additionally, guide-in and guide-out notches may be provided at the beginning and ending portions of recess 29.

Although not shown in greater detail, it will be appreciated that discharge openings 27 and channels 24 may be configured as having the same or different diameters. Discharge openings 27 and their adjoining channels 24 also may have variable diameters, and further may be arranged in varied angular positions relative to each other.

As it is anticipated that certain changes may be made in the present invention without departing from the precepts herein involved, it is intended that all matter contained in the foregoing description shall be interpreted as illustrative and not in a limiting sense. All references cited herein are expressly incorporated by reference.

What is claimed is:

1. An axial piston pump of a swash-plate variety comprising:

a cylinder block rotatable in a first radial direction about a central axis and having a plurality of cylinder bores formed therein about said central axis for angular displacement with the rotation of said cylinder, each of said bores being spaced-apart in said first radial direction from an adjacent one of said bores and extending in an axial direction generally parallel to said central axis from a first end opening to a second end opening;

a piston received in a corresponding one of each of said bores for sequentially reciprocating linear motion therein responsive to the rotation of said cylinder bock, each said piston being movable in said corresponding one of said bores in a first said axial direction towards the first end of said bore defining a suction stroke of said piston, and in an opposite, second said axial direction towards the second end of said bore defining a compression stroke of said piston;

a source of fluid pressure for providing a fluid capacitance to each of said pistons;

a valve plate aligned coaxially with said cylinder block as positioned over the second end openings of said bores, said valve plate having a low pressure connection port disposed at a first angular position relative to the rotation of said cylinder block and a high pressure connection port disposed at a second angular position spaced-apart radially from said low pressure connection port by a web of said valve plate;

a first channel formed in said valve plate web intermediate said low and said high pressure connection port, said first channel extending axially through said valve plate between a first inlet opening coupled in fluid communication with said source of said fluid pressure, and a first discharge opening selectively couplable in fluid communication with the second end openings of said bores;

a second channel formed in said valve plate web intermediate said low and said high pressure connection port, said second channel being radially spaced-apart from said first channel and extending axially through said valve plate between a second inlet opening coupled in fluid communication with said source of said fluid pressure, and a second discharge opening selectively couplable in fluid communication with the second end openings of said bores;

a first guide notch formed into said valve plate web about said first discharge opening and elongated in a second radial direction opposite said first radial direction; and a second guide notch formed into said valve plate web about said second discharge opening and elongated in said first radial direction;

whereby the second end openings of said bores are sequentially registered in fluid communication with said low pressure connection port during the suction stroke of each said piston, and with said high pressure connection port during the compression stroke of each said piston; and whereby the second end openings of said bores additionally are sequentially registered in fluid communication with the first discharge opening of said first channel and with the second discharge opening of said second channel to supply said fluid pressure to each said piston as said bores pass along said web of said valve plate.

2. The piston pump of claim 1 further comprising a connection plate aligned coaxially with said valve plate as disposed opposite said cylinder block, said connection plate having a chamber containing said source of said fluid pressure and having a conduit formed therein, said conduit extending axially in said connection plate from a first end coupled in fluid communication with said chamber to a second end coupled in fluid communication with the first inlet end of said valve plate first channel.

3. The piston pump of claim 1 wherein said low and said high pressure connection port and the first and the second discharge opening of, respectively, said first and said second channel are aligned in said valve plate along a common arc relative to said central axis.

4. The piston pump of claim 1 wherein said first and said second channel are of equal diameters.

5. The piston pump of claim 1 wherein said first and said second channels are of different diameters.

6. An axial piston pump of a swash-plate variety comprising:

a cylinder block rotatable in a first radial direction about a central axis and having a plurality of cylinder bores formed therein about said central axis for angular displacement with the rotation of said cylinder, each of said bores being spaced-apart in said first radial direction from an adjacent one of said bores and extending in an axial direction generally parallel to said central axis from a first end opening to a second end opening;

a piston received in a corresponding one of each of said bores for sequentially reciprocating linear motion therein responsive to the rotation of said cylinder bock, each said piston being movable in said corresponding one of said bores in a first said axial direction towards the first end of said bore defining a suction stroke of said piston, and in an opposite, second said axial direction towards the second end of said bore defining a compression stroke of said piston;

a source of fluid pressure for providing a fluid capacitance to each of said pistons;

a valve plate aligned coaxially with said cylinder block as positioned over the second end openings of said bores, said valve plate having a low pressure connection port disposed at a first angular position relative to the rotation of said cylinder block and a high pressure connection port disposed at a second angular position spaced-apart radially from said low pressure connection port by a web of said valve plate;

a first channel formed in said valve plate web intermediate said low and said high pressure connection port, said first channel extending axially through said valve plate between a first inlet opening coupled in fluid communication with said source of said fluid pressure, and a first discharge opening selectively couplable in fluid communication with the second end openings of said bores;

a second channel formed in said valve plate web intermediate said low and said high pressure connection port, said second channel being radially spaced-apart from said first channel and extending axially through said valve plate between a second inlet opening coupled in fluid communication with said source of said fluid pressure, and a second discharge opening selectively couplable in fluid communication with the second end openings of said bores; and a recess formed into said valve plate web, said recess surrounding and connecting said first and said second discharge opening;

whereby the second end openings of said bores are sequentially registered in fluid communication with said low pressure connection port during the suction stroke of each said piston, and with said high pressure connection port during the compression stroke of each said piston; and whereby the second end openings of said bores additionally are sequentially registered in fluid communication with the first discharge opening of said first channel and with the second discharge opening of said second channel to supply said fluid pressure to each said piston as said bores pass along said web of said valve plate.

7. The piston pump of claim 6 further comprising a connection plate aligned coaxially with said valve plate as disposed opposite said cylinder block, said connection plate having a chamber containing said source of said fluid pressure and having a conduit formed therein, said conduit extending axially in said connection plate from a first end coupled in fluid communication with said chamber to a second end coupled in fluid communication with the first inlet end of said valve plate first channel.

8. The piston pump of claim 6 wherein said low and said high pressure connection port and the first and the second discharge opening of, respectively, said first and said second channel are aligned in said valve plate along a common arc relative to said central axis.

9. The piston pump of claim 6 wherein said first and said second channel are of equal diameters.

10. The piston pump of claim 6 wherein said first and said second channels are of different diameters.

11. The piston pump of claim 6 wherein said recess has a beginning portion and an ending portion, said beginning portion being configured as a first guide notch elongated in a second radial direction opposite said first radial direction, and said ending portion being configured as a second guide notch elongated in said first radial direction.

* * * * *